US008342619B2

(12) United States Patent
Seo et al.

(10) Patent No.: US 8,342,619 B2
(45) Date of Patent: Jan. 1, 2013

(54) REFRIGERATOR WITH HEIGHT-ADJUSTABLE RECEIVING APPARATUS

(75) Inventors: Woon Kyu Seo, Gyeongsangnam-do (KR); Jung Yeon Hwang, Gyeongsangnam-do (KR); Han Jin Jung, Gyeongsangnam-do (KR); Hyeon Jin Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 317 days.

(21) Appl. No.: 12/724,708

(22) Filed: Mar. 16, 2010

(65) Prior Publication Data

US 2010/0301723 A1 Dec. 2, 2010

(30) Foreign Application Priority Data

May 27, 2009 (KR) ..... 10-2009-0046546

(51) Int. Cl.
*A47B 96/04* (2006.01)

(52) U.S. Cl. ..... 312/405.1; 312/247; 312/321.5; 312/306

(58) Field of Classification Search ..... 312/404, 312/405, 405.1, 408, 321.5, 246–247, 306, 312/312; 62/440, 449, 337
See application file for complete search history.

(56) References Cited

U.S. PATENT DOCUMENTS

| | | | | |
|---|---|---|---|---|
| 2,024,436 | A * | 12/1935 | Eickmeyer | 62/267 |
| 2,841,459 | A * | 7/1958 | Sharpe | 312/306 |
| 5,199,778 | A * | 4/1993 | Aoki et al. | 312/408 |
| 5,913,584 | A * | 6/1999 | Swindell et al. | 312/408 |
| 6,065,821 | A * | 5/2000 | Anderson et al. | 312/408 |
| 6,363,738 | B2 * | 4/2002 | Nakajima et al. | 62/440 |
| 8,047,623 | B2 * | 11/2011 | Kang et al. | 312/408 |
| 2003/0011291 | A1 * | 1/2003 | Moreno-Olguin et al. | 312/405.1 |
| 2008/0246382 | A1 * | 10/2008 | Kang et al. | 312/408 |

* cited by examiner

*Primary Examiner* — Hanh V Tran
(74) *Attorney, Agent, or Firm* — Fish & Richardson P.C.

(57) ABSTRACT

Provided is a refrigerator including a height-adjustable receiving apparatus in which a rotation gear is vertically moved along a fixed shaft disposed on a mounting member when the rotation gear disposed on a receiving member is rotated, and the receiving member is adjustable in vertical height. The height-adjustable receiving apparatus includes a receiving member in which foods are received, a mounting member on which the receiving member is vertically movably mounted, a fixed shaft longitudinally disposed on the mounting member, a rotation gear disposed on the receiving member, an operation member disposed on the receiving member, and a transmission member disposed on the receiving member.

15 Claims, 11 Drawing Sheets

REFRIGERATOR WITH HEIGHT-ADJUSTABLE RECEIVING APPARATUS

CROSS-REFERENCE TO RELATED APPLICATIONS

The present application claims priority under U.S.C. 119 and 35 U.S.C. 365 to Korean Patent Application No. 10-2009-0046546 (27 May, 2009), which is hereby incorporated by reference in its entirety.

BACKGROUND

The present disclosure relates to a refrigerator with a height-adjustable receiving apparatus.

Generally, a refrigerator is a home appliance, which stores foods in a storage space that is shielded by a refrigerator door in order to keep foods at low temperatures, and enables foods to be stored in a fresh state by cooling the inside of the storage space using cold air generated through heat exchange with refrigerant that circulates through a cooling cycle.

Due to changes in dietary life and well-being trends, consumers prefer larger, multi-functional refrigerators, and various convenient refrigerators have been introduced in the market.

Shelves, drawers, and baskets are disposed within a refrigerator and on a back surface of a door to store various foods in freezing and refrigerating states. The shelves and baskets disposed within the refrigerator or on the back surface of the door are classified according to sizes of the foods to be stored, and then disposed at desired positions to improve the space utilization efficiency within the refrigerator.

However, in order to adjust heights of the shelves and the baskets in a state where the foods are stored in the shelves and the baskets, the shelves and baskets should be separated after the foods are carried out the shelves and baskets. Then, the shelves and baskets should be disposed again at desired positions to store the foods again in the shelves and baskets.

To solve such a limitation, refrigerators in which shelves and baskets can be adjusted in height in a state where they are installed to improve convenience of use are being developed in recent years.

SUMMARY

In one embodiment, a height-adjustable receiving apparatus includes: a receiving member in which foods are received; a mounting member on which the receiving member is vertically movably mounted, the mounding member being disposed on a back surface of a door; a fixed shaft longitudinally disposed on the mounting member; a rotation gear disposed on the receiving member, the rotation gear being vertically moved together with the receiving member along the fixed shaft by the rotation thereof; an operation member disposed on the receiving member, the operation member being operated to move the receiving member; and a transmission member disposed on the receiving member, the transmission member being moved by the operation of the operation member to rotate the rotation gear.

In another embodiment, a refrigerator with a height-adjustable receiving member includes: a receiving member having a shelf shape in which foods are received; a mounting member on which the receiving member is vertically movably mounted, the mounding member being disposed on a wall within the refrigerator; a fixed shaft longitudinally disposed on the mounting member; a rotation gear disposed on the receiving member, the rotation gear through which the fixed shaft passes being vertically moved together with the receiving member while it is rotated along the fixed shaft; a transmission member disposed on the receiving member, the transmission member rotating the rotation gear; and an operation member exposed to the outside of the receiving member, the operation member being coupled to the transmission member to operate the rotation of the transmission member.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. However, the sprit of the present disclosure is not limited to the embodiments, and other embodiments by modifications, additions, and deletions of other element also fall on the sprit of the present disclosure.

Figure 1:
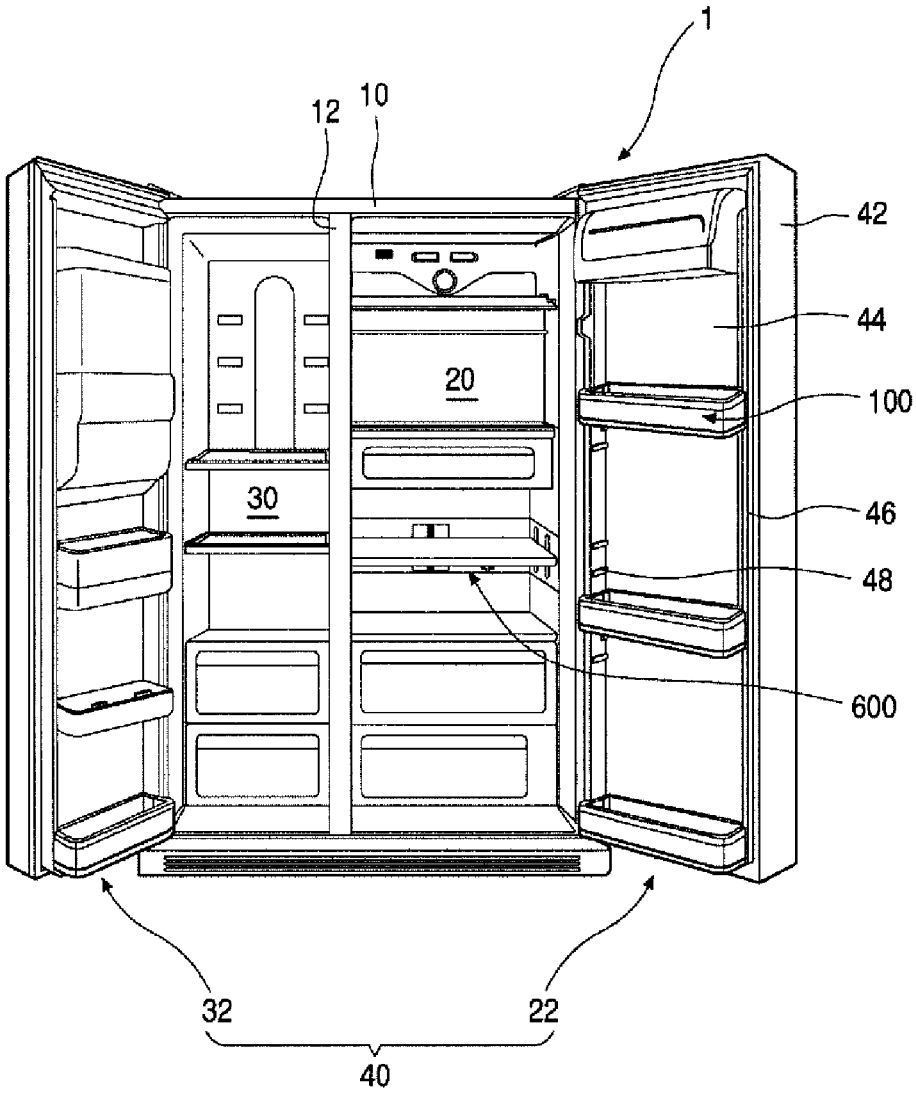
FIG. 1 is a perspective view of a refrigerator with its doors open according to an embodiment.

FIG. 1 is a perspective view of a refrigerator with its doors open according to an embodiment.

A receiving member of a height-adjustable receiving apparatus according to an embodiment includes a basket. The height-adjustable receiving apparatus is disposed on a door.

Referring to FIG. 1, a refrigerator 1 according to an embodiment includes a cabinet 10 defining a storage space therein and a door 40 selectively opening and closing an opened surface of the cabinet 10. An outer appearance of the refrigerator 1 is defined by the cabinet 10 and the door 40.

The storage space within the cabinet 10 may be horizontally partitioned by a barrier 12 to define a refrigerator compartment 20 and a freezer compartment 30. The door 40 may include a freezer compartment door 32 and a refrigerator compartment door 22, which open and close the freezer compartment 30 and the refrigerator compartment 20, respectively.

A receiving member 200 such as a shelf, a drawer, and a basket is disposed in the storage space with the cabinet 10 and on the door 40 to store foods. The receiving member 200 receives the foods to be stored, and the foods are stored in proper positions according to their size and storage condition.

The door 40 may be rotatably hinge-coupled to the cabinet 10. The door 40 may include an outer case 42 defining a front surface and a circumference surface thereof and a door liner 44 defining a configuration of a back surface of the door 40 inside the refrigerator.

The door liner 44 may be formed of a plastic material. A plurality of receiving parts such as baskets may be disposed inside the door liner 44 to store the foods. In detail, a portion of the door liner 44 protrudes along a circumference of the back surface of the door 40 to form a circumference part 46. A mounting protrusion 48 on which a height-adjustable receiving apparatus 100 is mounted is disposed inside the circumference part 46. The circumference part 46 may be provided in plurality. The circumference part 46 may be configured to mount the height-adjustable receiving apparatus 100 at a position desired by a user.

Figure 2:
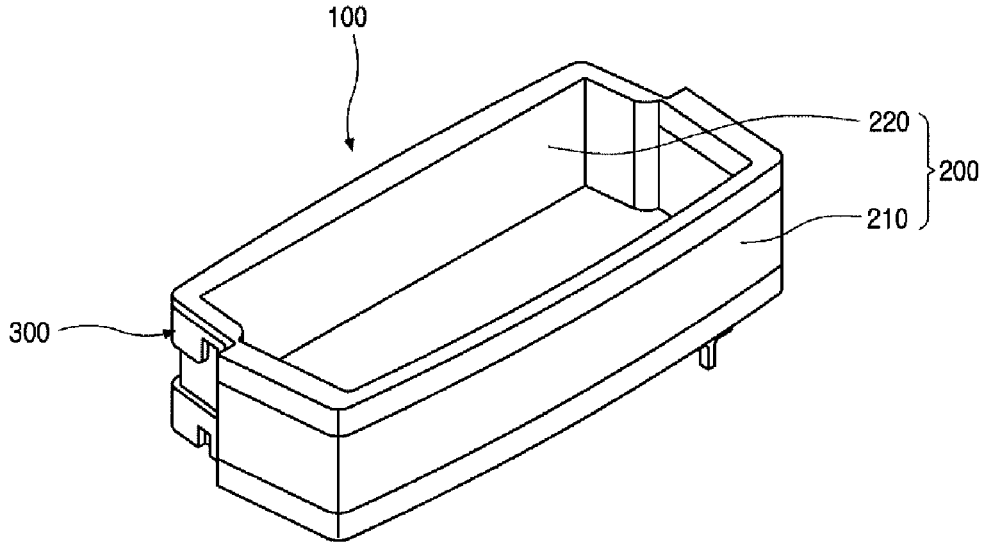
FIG. 2 is a perspective view of a refrigerator door basket when viewed from an upward direction according to an embodiment.
Figure 3:
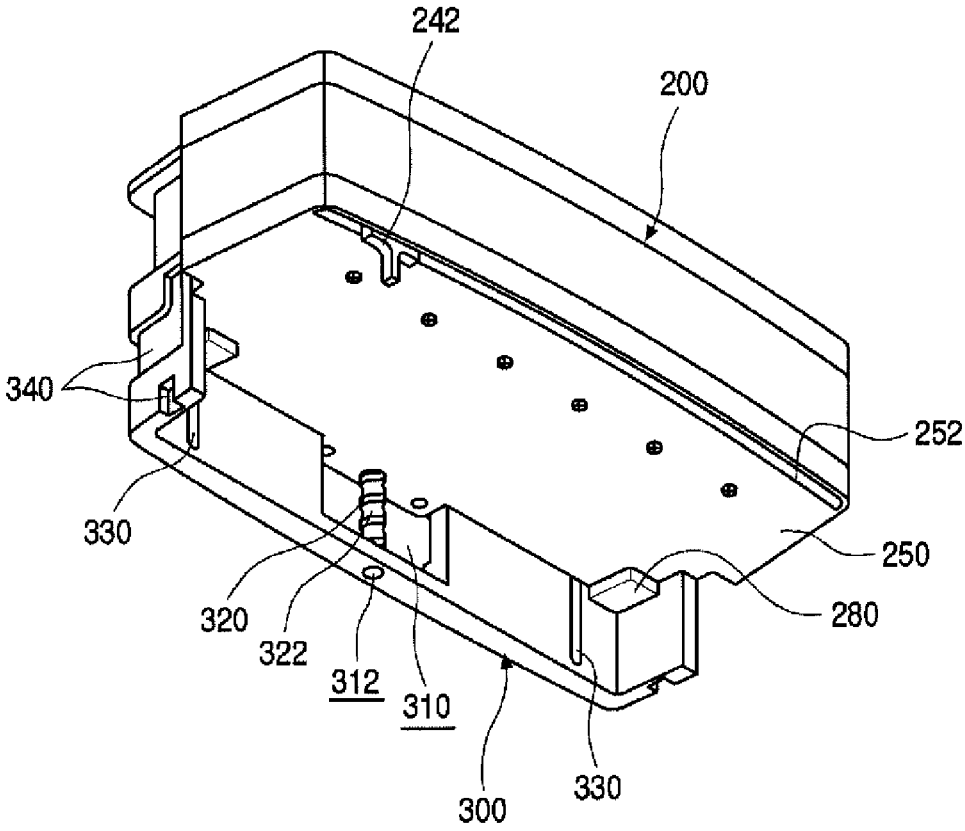
FIG. 3 is a perspective view of the refrigerator door basket when viewed from a downward direction according to an embodiment.
Figure 4:
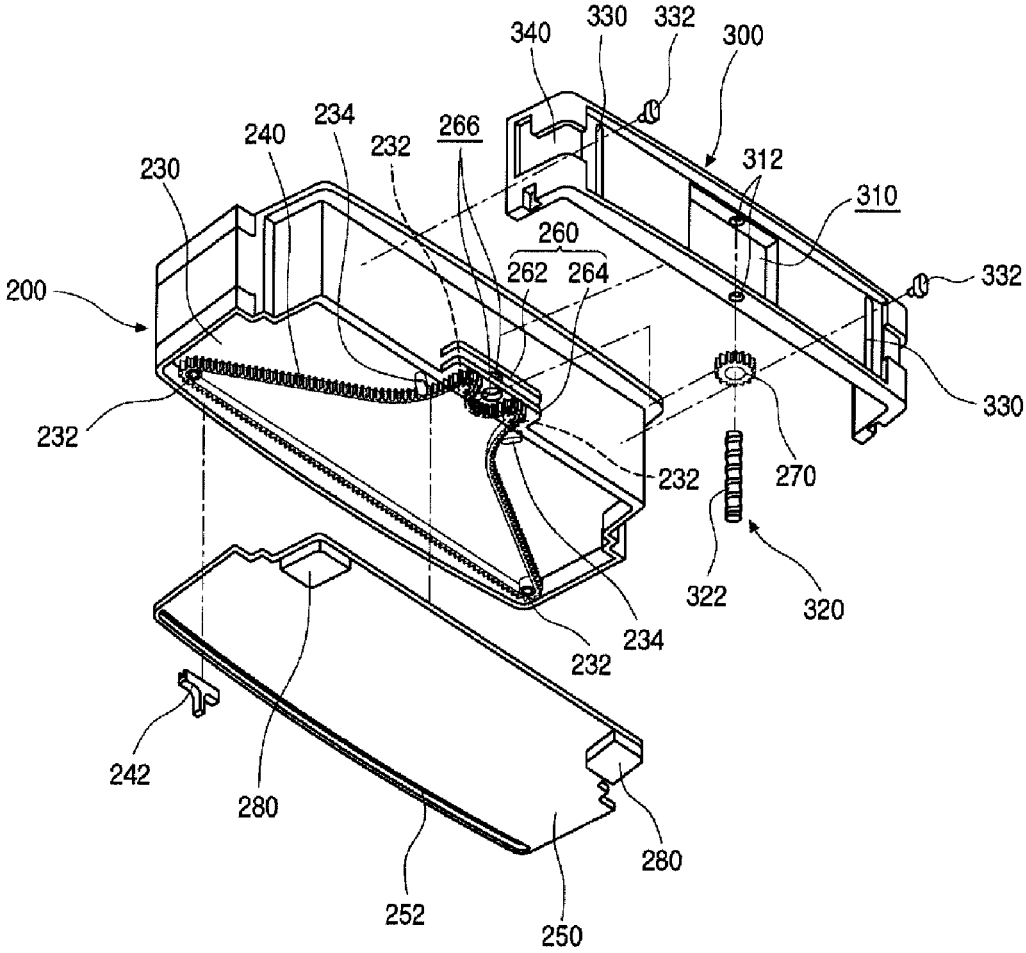
FIG. 4 is an exploded perspective view of the refrigerator door basket according to an embodiment.

FIG. 2 is a perspective view of a refrigerator door basket when viewed from an upward direction according to an embodiment, FIG. 3 is a perspective view of the refrigerator door basket when viewed from a downward direction according to an embodiment, and FIG. 4 is an exploded perspective view of the refrigerator door basket according to an embodiment.

Referring to FIGS. 2 to 4, the height-adjustable receiving apparatus 100 includes a receiving member 200 for receiving the foods, a mounting member 300 disposed on the door 40, and a plurality of parts for vertically moving the receiving member 200. The receiving member 200 is vertically movably disposed on the mounting member 300.

The foods to be stored are received into the receiving member 200, and the receiving member 200 may have a basket shape having an opened upper surface to receive the foods therein. The receiving member 200 has a size corresponding to a horizontal width of the door 40. Also, at least portion of a front surface and lateral surfaces of the receiving member 200 may be formed of a transparent material.

In detail, the receiving member 200 may include an exposed part 210 defining a front portion of the circumference thereof and a mounting part 220 defining a rear portion. The exposed part 210 is exposed to a rear side of the door 40 when the receiving member 200 is fixedly disposed on the door 40. At least portion of the exposed part 210 may be formed of a transparent material. The mounting part 220 has a width less than that of the exposed part 210 and contacts an inner surface of the mounting member 300.

An inwardly depressed receiving part 230 is defined in a bottom surface of the receiving member 200. A transmission member 240 for transmitting a power for vertically moving the receiving member 200 may be disposed inside the receiving part 230.

A timing belt having a continuous gear shape may be used as the transmission member 240. An operation member 242 operable by the user from the outside may be disposed on the timing belt.

The operation member 242 is fixedly disposed at a side of the transmission member 240. At least portion of the operation member 242 may be exposed to the outside of a receiving part cover 250 disposed on the bottom surface of the receiving member 200 to allow the user to operate the operation member 242.

The receiving part cover 250 covers the receiving part 230. A guide slot 252 is disposed on the receiving part cover 250 to move the operation member 242. That is, a portion of the operation member 242 passes through the guide slot 252 to expose the portion thereof, and the transmission member 240 is rotated according to the movement of the operation member 242.

Four guide rollers 232 are disposed inside the receiving part 230. A tension of the transmission member 240 is adjusted by the guide rollers 232. Also, when the operation member 242 is operated, the guide rollers 232 may operate a rotation gear 270 to be described below to smoothly rotate the transmission member 240. The guide rollers 232 may be disposed at positions corresponding to both sides of the guide slot 252 and both sides of the rotation gear 270, respectively.

At least two or more guide protrusions 234 protrude inside the receiving part 230. A movement direction of the transmission member 240 may be guided by the guide protrusions 234.

A backwardly protruding insertion part 260 may be disposed at a lower end of the back surface of the receiving member 200. The insertion part 260 passes through the mounting member 300. The insertion part 260 may be configured to mount the rotation gear 270 that is vertically moved while it is rotated along a fixed shaft 320 to be described below.

In detail, the insertion part 260 includes an insertion part upper portion 262 and an insertion part lower portion 264, which are spaced from each other. The rotation gear 270 is disposed at an approximately central portion between the insertion part upper portion 262 and the insertion part lower portion 264. Also, the rotation gear 270 may be disposed on the fixed shaft 320 passing through through-holes 266 defined in the insertion part upper portion 262 and the insertion part lower portion 264.

The pair of guide rollers 232 may be disposed between the insertion part upper portion 262 and the insertion part lower portion 264. The guide rollers 232 may be rotatably axially coupled to both sides of the rotation gear 270 or have a structure such as a bearing. The guide rollers 232 may be configured to stably couple the transmission member 240 to the rotation gear 270 to interlock with each other.

The mounting member 300 is disposed at rear side of the receiving member 200. The mounting member 300 has a shape surrounding portions of both sides of the receiving member 200 and the back surface of the receiving member 200. Thus, the mounting member 300 contacts the portions of both sides and the back surface of the receiving member 200.

An insertion part guide hole 310 having a width corresponding to that of the insertion part 260 is defined in an approximately central portion of the mounting member 300. The insertion part guide hole 310 may be vertically opened and have a height corresponding to a vertical movement distance of the receiving member 200. Thus, when the receiving member 200 is vertically moved, the insertion part guide hole 310 may guide the insertion part 260.

Shaft mounting holes 312 in which the fixed shaft 320 is inserted is defined in approximately central portions of upper and lower ends of the insertion part guide hole 310. Thus, the fixed shaft 320 may be disposed to vertically cross the insertion part guide hole 310. The fixed shaft 320 may sequentially pass through the insertion part 260 inserted into the insertion part guide hole 310 and the rotation gear 270.

A guide groove 322 having a spiral shape is defined in an outer surface of the fixed shaft 320. The guide groove 322 guides such that the rotation gear 270 is vertically moved along the fixed shaft 320 when the rotation gear is rotated. Also, a protrusion corresponding to the guide groove 322 may be further disposed on an inner surface of the rotation gear 270 to further effectively vertically move the rotation gear 270.

A vertical guide slot 330 is disposed on both left and right sides of a back surface of the mounting member 300. The vertical guide slot 330 prevents the receiving member 200 disposed on the mounting member 300 from being shaken to guide the vertical movement of the receiving member 200.

A coupling member 332 passing through the vertical guide slot 330 and coupled to the back surface of the receiving member 200 may be further disposed on the vertical guide slot 330. The receiving member 200 is fixedly coupled to the mounting member 300 by the coupling member 332. When the receiving member 200 is vertically moved, the coupling member 332 may be moved along the vertical guide slot 330.

A basket mounting groove 340 is defined in each of both left and right surfaces of the mounting member 300. The basket mounting groove 340 may be detachably coupled to the mounting protrusion 48 disposed on the door liner 44. The mounting protrusion 48 may be provided in plurality. Thus, the mounting protrusions 48 may be selected according to a mounting height of the mounting member 300.

A shake prevention member 280 may be further disposed on a bottom surface of the receiving member 200 as necessary. The shake prevention member 280 is disposed on a rear edge of the bottom surface of the receiving member 200 and has a predetermined height. Also, the shake prevention member 280 may be disposed on at least side of both sides of the receiving member 200.

Thus, the shake prevention member 280 contacts an inner edge of the mounting member 300 when the receiving member 200 is vertically moved. Also, the shape prevention member 280 is configured to vertically move the receiving member 200 without twisting.

Hereinafter, an operation of the refrigerator including the above-described components according to an embodiment will be described with reference to accompanying drawing.

Figure 5:
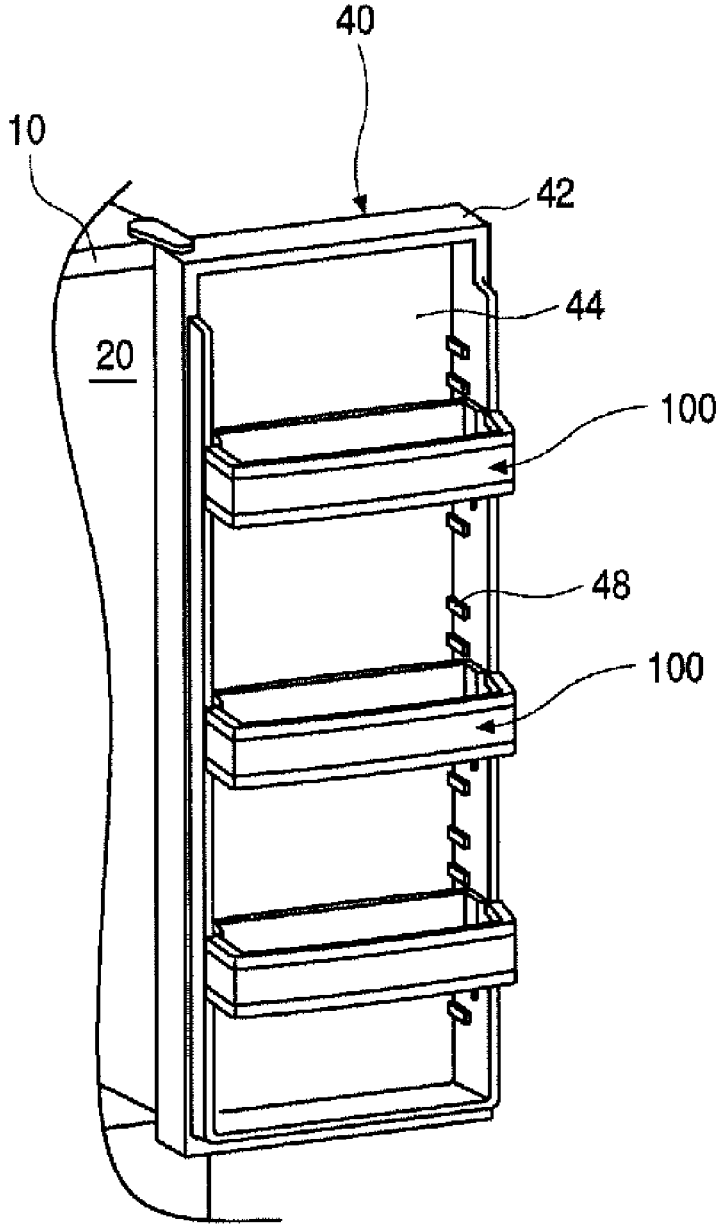
FIG. 5 is a partially perspective view of a refrigerator door in which receiving members are disposed at the lowest position according to an embodiment.
Figure 6:
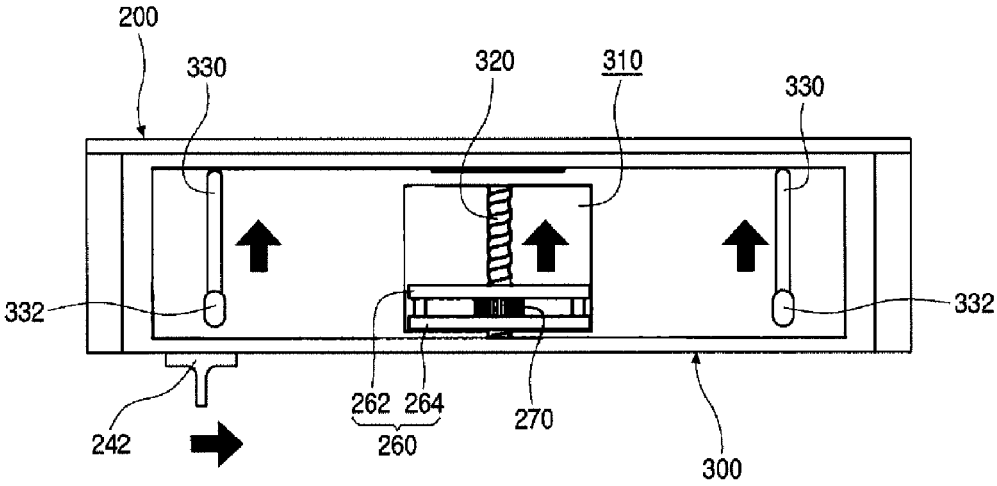
FIG. 6 is a rear view of the refrigerator door basket when the receiving members are disposed at the lowest position according to an embodiment.

FIG. 5 is a partially perspective view of a refrigerator door in which receiving members are disposed at the lowest position according to an embodiment, and FIG. 6 is a rear view of the refrigerator door basket when the receiving members are disposed at the lowest position according to an embodiment.

Referring to FIGS. 5 and 6, the height-adjustable receiving apparatus 100 may be disposed on the back surface of the door 40 because the mounting member 300 is seated on the mounting protrusion 48 of the door liner 44. At this time, the height-adjustable receiving apparatus 100 may be disposed on one of the plurality of mounting protrusions 48 by a user's selection to determine an initial mounting position thereof.

After the height-adjustable receiving apparatus 100 is disposed on the door 40, in a state where the receiving member 200 is disposed at the lowest position by a user's operation, the operation member 242 is disposed at a the most right side (a left side when viewed in FIG. 6).

When the receiving member 200 is disposed at the lowest position, the insertion part 260 of the receiving member 200 is disposed at the most lowest position of the insertion part guide hole 310. Also, the coupling member 332 is disposed at the lowest position of the vertical guide slot 330.

In this state, when the user moves the operation member 242 toward a left side (a right side when viewed in FIG. 6), the receiving member 20 is upwardly moved.

In detail, when the operation member 242 is moved in a left direction, the transmission member 240 coupled to the operation member 242 is rotated. As the transmission member 240 is rotated in a state where it is gear-coupled to the rotation gear 270, the rotation gear 270 may be rotated also.

When the rotation gear 270 is rotated, the rotation gear 270 is forcedly upwardly moved along the guide groove 322 of the fixed shaft 320. That is, the rotation gear 270 is rotated and upwardly moved at the same time.

When the rotation gear 270 is upwardly moved in a state where it is received into the insertion part 260 of the receiving member 200, the receiving member 200 is upwardly moved also inside the mounting member 300. At this time, the coupling member 332 is vertically moved also along the vertical guide slot 330.

Thus, when the upward movement of the receiving member 200 is required, the operation member 242 is moved to upwardly move the receiving member 200. When the receiving member is disposed at a desired position, an operation of the operation member 242 is stopped to complete the movement of the receiving member 200. Since the receiving member 200 is vertically moved to adjust a height of the storage space on the back surface of the door 40, a lower space of the basket may be widened, and an upper space of the basket may be reduced.

Figure 7:
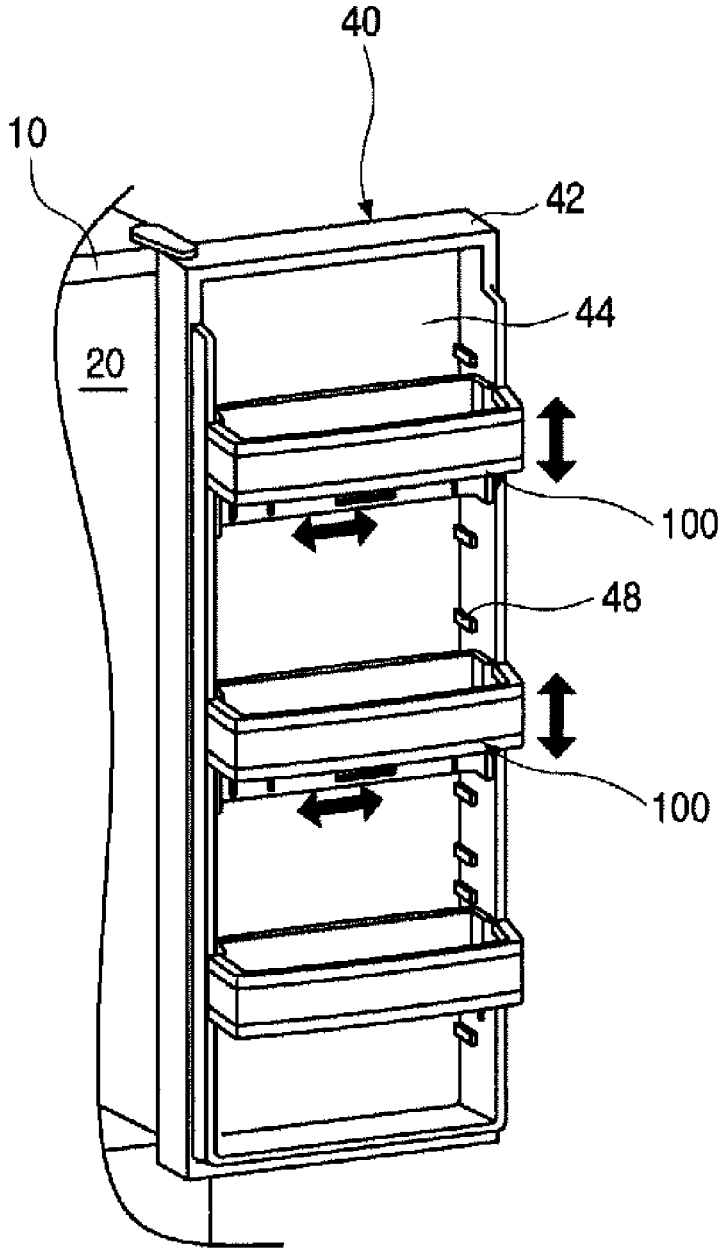
FIG. 7 is a partially perspective view of the refrigerator door in which the receiving members are disposed at the highest position according to an embodiment.
Figure 8:
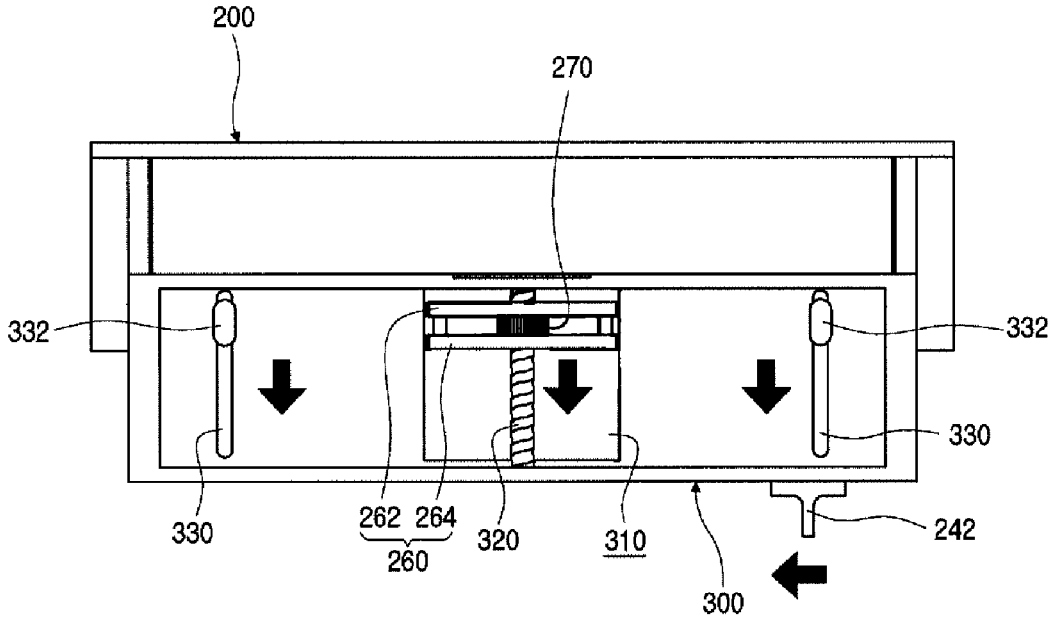
FIG. 8 is a rear view of the refrigerator door basket when the receiving members are disposed at the highest position according to an embodiment.

FIG. 7 is a partially perspective view of the refrigerator door in which the receiving members are disposed at the highest position according to an embodiment, and FIG. 8 is a rear view of the refrigerator door basket when the receiving members are disposed at the highest position according to an embodiment.

Referring FIGS. 7 and 8, when the operation member 242 is moved to the most left side (a right side when viewed in FIG. 8), the receiving member 200 is disposed at the most upper position. At this time, the insertion part 260 is disposed at the most upper side of the insertion part guide hole 310, and also, the coupling member 332 is disposed at the most upper end of the vertically guide slot 330.

In this state, the receiving member 200 may be downwardly moved by a user's operation. When the operation member 242 is moved in a right direction (a left side when viewed in FIG. 8) to downwardly move the receiving member 200. The transmission member 240 is rotated by the movement of the operation member 242 to rotate the rotation gear 270. The rotation gear 270 is rotated, and simultaneously, the rotation gear 270 is downwardly moved along the fixed shaft 320. Thus, the receiving member 200 may be moved downward.

The refrigerator 1 including the height-adjustable receiving apparatus 100 may be applicable to various embodiments except the above-described embodiment. Hereinafter, the various embodiments are described in detail with reference to accompanying drawings.

Figure 9:
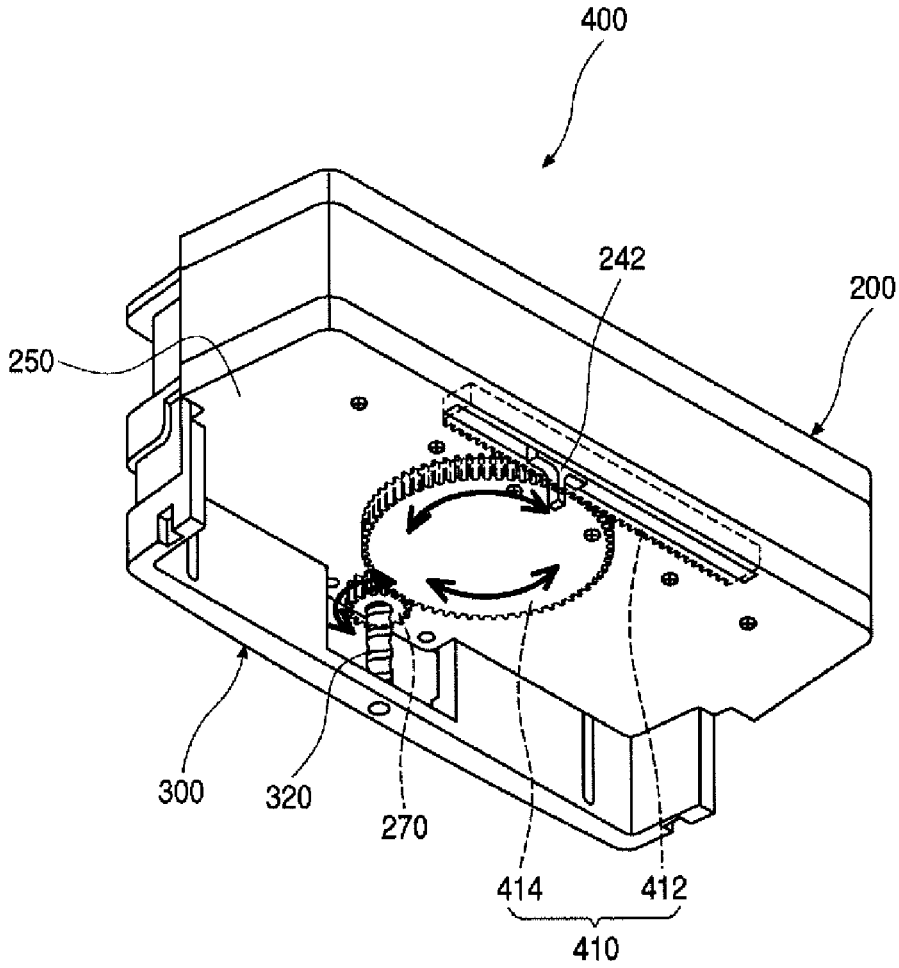
FIG. 9 is a perspective view of a basket according to another embodiment.

FIG. 9 is a perspective view of a basket according to another embodiment.

According to this embodiment, a rack member and a transmission gear are used as a transmission member for vertically moving a receiving member. The same components in this embodiment will be designated with the same reference numeral as those used in the previously described embodiment, and the description with respect thereto will be omitted.

Referring to FIG. 9, in a height-adjustable receiving apparatus 400 according to another embodiment, a receiving member 200 is vertically movably coupled to a mounting member 300. A transmission member 410 coupled to an operation member 242 is disposed in the receiving part (see reference numeral 230 of FIG. 4) disposed in a back surface of the receiving member 200.

The transmission member 410 includes a rack gear 412 and a transmission gear 414. The rack gear 412 is coupled to the operation member 242 and may be movable in left and right directions by an operation of the operation member 242 exposed to a receiving part cover 250.

The transmission gear 414 may be gear-coupled to the rack gear 412 and a rotation gear 270 inside the receiving part (see reference numeral 230 of FIG. 4). That is, the transmission gear 414 is rotated by a horizontal movement of the rack gear 412 due to the operation of the operation member 242. Also, the transmission gear 414 is rotated, and simultaneously, the rotation gear engaged with the transmission gear 414 is rotated.

The rotation gear 270 may be vertically moved with respect to a fixed shaft 320 while it is rotated in a state where it is installed on the fixed shaft 320. Thus, a user operates the operation member 242 to vertically move the receiving member 200.

The transmission gear 414 may include a plurality of gears combined with each other. In this case, a vertical movement distance of the receiving member 200 may be relatively long through a combination of a gear ratio even through a horizontal movement distance of the receiving member 200 is relatively short.

The refrigerator including the height-adjustable receiving apparatus 100 may be applicable to various embodiments except the above-described embodiment. Hereinafter, the various embodiments are described in detail with reference to accompanying drawings.

Figure 10:
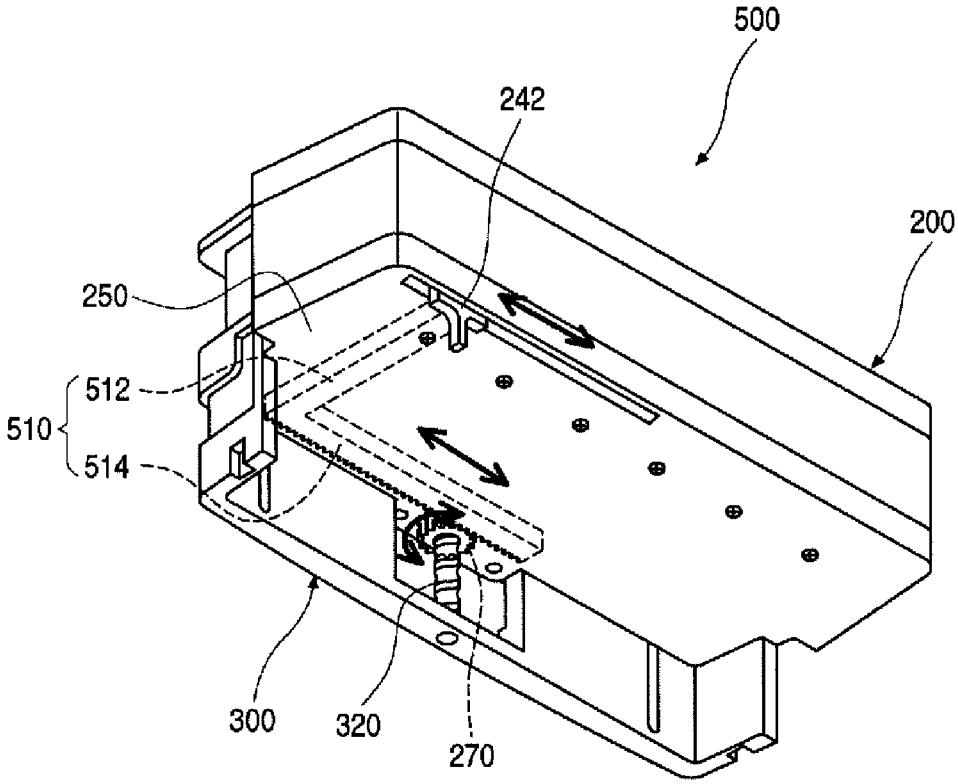
FIG. 10 is a perspective view of a basket according to another embodiment.

FIG. 10 is a perspective view of a basket according to another embodiment.

According to this embodiment, a rack gear is used as a transmission member for vertically moving a receiving member. The same components in this embodiment will be designated with the same reference numeral as those used in the previously described embodiment, and the description with respect thereto will be omitted.

Referring to FIG. 10, in a height-adjustable receiving apparatus 500 according to another embodiment, a receiving member 200 is vertically movably coupled to a mounting member 300. A transmission member 510 coupled to an operation member 242 is disposed in the receiving part (see reference numeral 230 of FIG. 4) disposed in a back surface of the receiving member 200.

The transmission member 510 (hereinafter, referred to as a rack member) includes a rack member. The rack member 510 is coupled to the operation member 242 and may be movable in left and right directions by an operation of the operation member 242 exposed to a receiving part cover 250.

The rack member 510 is coupled to the operation member 242. The rack member 510 includes an extension part 512 extending in a rear direction of the receiving member 200 and a gear part 514 extending laterally from the extension part 512 and including gear teeth gear-coupled to a rotation gear 270.

The extension part 512 may have various shapes according to positions of the operation member 242. The gear part 514 may have a sufficient length such that the receiving member 200 is vertically movable.

Thus, when the operation member 242 is moved by a user to adjust a height of the receiving member 200, the rack member 510 may be moved in the same direction as the operation member 242.

At this time, since the gear part 514 is engaged with the rotation gear 270, the gear part 514 and the rotation gear 270 are rotated when the rack member 510 is moved. The rotation gear may be vertically moved with respect to a fixed shaft 320 while it is rotated in a state where it is installed on the fixed shaft 230.

The refrigerator including the height-adjustable receiving apparatus 100 may be applicable to various embodiments except the above-described embodiments. Hereinafter, the various embodiments are described in detail with reference to accompanying drawings.

Figure 11:
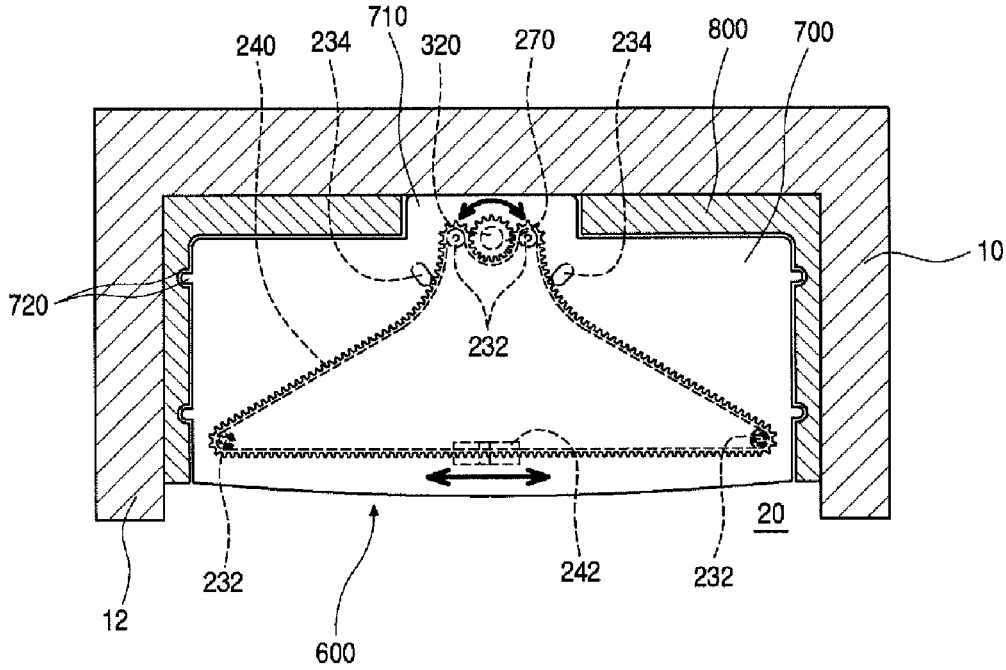
FIG. 11 is a partially sectional view of a refrigerator in which a shelf is installed according to another embodiment.

FIG. 11 is a partially sectional view of a refrigerator in which a shelf is installed according to another embodiment.

According to this embodiment, a receiving member of a height-adjustable receiving member includes a shelf, and the height-adjustable receiving member is disposed in a cabinet. The same components in this embodiment will be designated with the same reference numeral as those used in the previously described embodiment, and the description with respect thereto will be omitted.

Referring to FIG. 11, at least one or more height-adjustable receiving members 600 are provided in a refrigerator compartment 20 or a freezer compartment 30 partitioned by a barrier 12 inside a cabinet 10.

The height-adjustable receiving member 600 may include a shelf 700 (hereinafter, referred to as a receiving member) on which foods are seated and a mounting member 800 guiding a vertical movement of the receiving member 700.

A transmission member 240 having a timing belt shape is disposed on an inner surface or a bottom surface of the receiving member 700. A plurality of guide rollers 232 and a plurality of guide protrusions 234 are may be disposed to adjust a tension of the transmission member 240 and guide the transmission member 240.

An insertion part 710 is disposed at a rear end of the receiving member 700. A rotation gear 270 engaged and rotated with the transmission member 240 is disposed in the insertion part 710. The rotation gear 270 is vertically moved while it is rotated along a fixed shaft 320 disposed on a mounting member 800.

The mounting member 800 receives the insertion part 710 of the receiving member 700, and also guides the receiving member 700 when the receiving member 700 is upwardly moved along the fixed shaft 320.

Protrusions and movement guides 720 having a groove shape, which correspond to each other are disposed on/in both side surfaces of the receiving member 700 to smoothly guide a vertical movement of the receiving member 700.

The mounting member 800 may be detachably disposed within a refrigerator. The mounting member 800 may be integrated with a wall of the refrigerator as necessary. The mounting member 800 may be disposed at positions having different heights within the refrigerator due to the detachment thereof. The receiving member 700 may be adjusted in height even through it is installed.

Thus, to adjust the height of the receiving member 700, an operation member 242 disposed at a front side of the shelf is horizontally operated to rotate the transmission member 240. As a result, the rotation gear 270 rotated by the transmission member 240 is vertically moved along the fixed shaft 320. As the rotation gear 270 is vertically moved, the receiving member may be vertically moved also.

According to this embodiment, the operation member is horizontally operated to rotate the transmission member. When the rotation gear is rotated, the receiving member and the rotation gear are vertically moved along the fixed shaft to adjust the height of the receiving member.

Thus, since the height of the receiving member may be adjustable in a state where the receiving member is installed without performing a separate operation, convenience of use may be improved.

In addition, the storage space within the refrigerator may be effectively utilized by adjusting the height of the receiving member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A height-adjustable receiving apparatus comprising:

a receiving member in which foods are received;

a mounting member on which the receiving member is vertically movably mounted, the mounting member being detachably coupled on a back surface of a door;

a fixed shaft longitudinally disposed on the mounting member;

a rotation gear disposed on the receiving member, the rotation gear being vertically moved together with the receiving member along the fixed shaft by the rotation thereof wherein the fixed shaft passes through the rotation gear and a side of the receiving member;

an operation member disposed on the receiving member, the operation member being operated to move the receiving member;

a transmission member disposed on the receiving member, the transmission member being moved by the operation of the operation member to rotate the rotation gear;

multiple sets of mounting protrusions disposed on the back surface of the door, each set of mounting protrusions being disposed at a different height on the back surface of the door; and basket mounting grooves defined on the mounting member to detachably couple to one of the multiple sets of mounting protrusions, the basket mounting grooves enabling user selection of an initial mounting height of the receiving member based on selection of which of the multiple sets of mounting protrusions to mount the mounting member, the initial mounting height of the receiving member being further adjustable through operation of the operation member.

2. The height-adjustable receiving apparatus according to claim 1, wherein the receiving member has a basket shape.

3. The height-adjustable receiving apparatus according to claim 1, wherein a guide groove is defined in an outer surface of the fixed shaft such that the rotation gear to be moved along the fixed shaft when the rotation gear is rotated.

4. The height-adjustable receiving apparatus according to claim 1, wherein the transmission member comprises a timing belt gear-coupled to the rotation gear.

5. The height-adjustable receiving apparatus according to claim 4, wherein a guide roller is disposed on the receiving member to maintain a tension of the transmission member and smoothly rotate the transmission member.

6. The height-adjustable receiving apparatus according to claim 1, further comprising an insertion part in which the rotation gear is inserted such that the fixed shaft passes through the rotation gear, the insertion part being disposed at a rear end of the receiving member to pass through the mounting member.

7. The height-adjustable receiving apparatus according to claim 1, further comprising a vertically extending vertical guide slot on a back surface of the mounting member, and a coupling member passing through the vertical guide slot, the coupling member being coupled to the receiving member, wherein the receiving member is vertically movable by the coupling member in a state where the receiving member is coupled to the mounting member.

8. The height-adjustable receiving apparatus according to claim 1, wherein an inwardly depressed receiving part is defined in a bottom surface of the receiving member, the operation member and the transmission member being disposed on a bottom surface of the receiving member.

9. The height-adjustable receiving apparatus according to claim 8, wherein a receiving part cover covers the bottom surface of the receiving member on which the operation member, the transmission member, and the rotation gear are disposed.

10. The height-adjustable receiving apparatus according to claim 1, wherein the transmission member comprises:

a rack gear horizontally moved by the operation member; and a transmission gear engaged and rotated with the rack gear and the rotation gear.

11. The height-adjustable receiving apparatus according to claim 10, wherein the transmission gear is provided in plurality, and the plurality of transmission gears has a gear ratio different from each other.

12. The height-adjustable receiving apparatus according to claim 1, wherein the transmission member comprises a rack member horizontally moved by the operation member and engaged with the rotation gear to rotate the rotation gear.

13. The height-adjustable receiving apparatus according to claim 12, wherein the rack member comprises:

an extension part coupled to the operation member, the extension part extending toward a rear end of the receiving member; and a gear part extending laterally from the extension part, the gear part comparing gear teeth engaged with the rotation gear.

14. The height-adjustable receiving apparatus according to claim 1, wherein the basket mounting grooves comprise a basket mounting groove defined in each of both left and right surfaces of the mounting member, each basket mounting groove being detachably coupled to a mounting protrusion disposed on the back surface of the door.

15. The height-adjustable receiving apparatus according to claim 1, further comprising:

an insertion part protruded at a back surface of the receiving member; and an insertion part guide hole defined in an approximately central portion of the mounting member, the insertion part passing through the insertion part guide hole, wherein the insertion part guide hole is vertically opened and has a height corresponding to a vertical movement distance of the receiving member.

* * * * *